US010759168B2

(12) United States Patent
Dodd et al.

(10) Patent No.: US 10,759,168 B2
(45) Date of Patent: Sep. 1, 2020

(54) SUPPORT SUBSTRATES FOR MICROFLUIDIC DIE

(71) Applicants: STMICROELECTRONICS, INC., Coppell, TX (US); STMICROELECTRONICS INTERNATIONAL N.V., Amsterdam (NL); STMICROELECTRONICS S.R.L., Agrate Brianza (IT)

(72) Inventors: Simon Dodd, West Linn, OR (US); David S. Hunt, San Diego, CA (US); Joseph Edward Scheffelin, San Diego, CA (US); Dana Gruenbacher, Fairfield, OH (US); Stefan H. Hollinger, Kronberg im Taunus (DE); Uwe Schober, Schlossborn (DE); Peter Janouch, Frankfurt (DE)

(73) Assignees: STMICROELECTRONICS S.r.l., Agrate Brianza (IT); STMICROELECTRONICS, INC., Coppell, TX (US); STMICROELECTRONICS INTERNATIONAL N.V., Schiphol (NL)

( * ) Notice: Subject to any disclaimer, the term of this patent is extended or adjusted under 35 U.S.C. 154(b) by 0 days.

(21) Appl. No.: 16/357,077

(22) Filed: Mar. 18, 2019

(65) Prior Publication Data

US 2019/0217611 A1 Jul. 18, 2019

Related U.S. Application Data

(63) Continuation of application No. 15/253,601, filed on Aug. 31, 2016, now Pat. No. 10,272,684.

(Continued)

(51) Int. Cl.
*B41J 2/14* (2006.01)
*B41J 2/175* (2006.01)

(52) U.S. Cl.
CPC ..... *B41J 2/1433* (2013.01); *B41J 2/14072* (2013.01); *B41J 2/14201* (2013.01);
(Continued)

(58) Field of Classification Search
CPC .. B41J 2/1433; B41J 2/14072; B41J 2/14201; B41J 2/1753; B41J 2/17553; B41J 2002/14362; B41J 2002/14491
See application file for complete search history.

(56) References Cited

U.S. PATENT DOCUMENTS 7,149,090 B2 12/2006 Suzuki et al.
2004/0183859 A1 9/2004 Ito
(Continued)

*Primary Examiner* — Bradley W Thies
(74) *Attorney, Agent, or Firm* — Seed IP Law Group LLP

(57) ABSTRACT

The present disclosure provides supports for microfluidic die that allow for nozzles of the microfluidic die to be on a different plane or face a different direction from electrical contacts on the same support. This includes a rigid support having electrical contacts on a different side of the rigid support with respect to a direction of ejection of the nozzles, and a semi-flexible support or semi-rigid support that allow the electrical contacts to be moved with respect to a direction of ejection of the nozzles. The semi-flexible and semi-rigid supports allow the die to be up to and beyond a 90 degree angle with respect to a plane of the electrical contacts. The different supports allow for a variety of positions of the microfluidic die with respect to a position of the electrical contacts.

20 Claims, 10 Drawing Sheets

Related U.S. Application Data

(60) Provisional application No. 62/273,260, filed on Dec. 30, 2015.

(52) U.S. Cl.
CPC ..... *B41J 2/1753* (2013.01); *B41J 2/17553* (2013.01); *B41J 2002/14362* (2013.01); *B41J 2002/14491* (2013.01)

(56) References Cited

U.S. PATENT DOCUMENTS

| | | | | |
|---|---|---|---|---|
| 2007/0182787 | A1 | 8/2007 | Kubo et al. | |
| 2008/0316255 | A1 | 12/2008 | Kubo et al. | |
| 2011/0254898 | A1 | 10/2011 | Muraoka et al. | |
| 2012/0113192 | A1* | 5/2012 | Kimura ..... | H05K 1/028 347/54 |
| 2015/0130873 | A1 | 5/2015 | Kodoi et al. | |
| 2015/0373840 | A1 | 12/2015 | Dodd et al. | |
| 2017/0080715 | A1 | 3/2017 | Chen et al. | |

* cited by examiner

SUPPORT SUBSTRATES FOR MICROFLUIDIC DIE

BACKGROUND

Technical Field

The present disclosure is directed to rigid, semi-flexible, and semi-rigid supports that each support a microfluidic die.

Description of the Related Art

A traditional inkjet system utilizes a thermal or piezoelectric inkjet die that includes a plurality of nozzles. The inkjet die is typically coupled to a flexible interconnect that electrically couples the inkjet die to an electrical drive system of an electronic device, such as a printer. The flexible interconnect allows the inkjet die, more specifically the nozzles, and electrical contacts of the electronic device to be on different physical planes and locations. The inkjet die and the flexible interconnect, or TAB Head Assembly (THA), is then mounted on a body, such as a cartridge.

Unfortunately, the flexible interconnect is very expensive and, thus, greatly adds to the overall manufacturing cost of the inkjet cartridge. The high cost of the flexible interconnect is particularly problematic for disposable inkjet cartridges that are regularly being discarded and replaced.

BRIEF SUMMARY

The present disclosure is directed to a variety of supports for microfluidic die that allow for nozzles of the microfluidic die to be on a different plane or face a different direction from electrical contacts on the same support. This includes a rigid support with electrical contacts on a different side of the support with respect to a direction of ejection of the nozzles, and a semi-flexible support or semi-rigid support that allow the contacts to be moved with respect to a direction of ejection of the nozzles. The semi-flexible and semi-rigid supports allow the die to be at a 90 degree angle with respect to a plane of the electrical contacts. The different supports allow for a variety of positions of the microfluidic die with respect to positions of the electrical contacts. Different uses, each having different housings, may call for a different positioning of the microfluidic die with respect to the electrical contacts.

Each support is configured to support a microfluidic die on a first physical plane and location and support electrical contacts, which are electrically coupled to the microfluidic die, on a second physical plane and location. According to one embodiment, the rigid support includes a first surface and an opposite second surface. The microfluidic die is positioned on the first surface on a first end of the rigid support. The electrical contacts are positioned on the second surface on a second end, opposite the first end, of the rigid support.

According to one embodiment, the semi-flexible support includes a first rigid portion, a flexible portion, and a second rigid portion. The first rigid portion is separated from the second rigid portion by the flexible portion. The flexible portion may be fabricated by milling or thinning a specific portion of the semi-flexible support. By thinning the flexible portion, the semi-flexible support may be bent up to and beyond 90 degrees. The microfluidic die is positioned on the first rigid portion, and the electrical contacts are positioned on the second rigid portion.

According to one embodiment, the semi-rigid support includes a rigid portion and a flexible portion that extends from the rigid portion. The microfluidic die is positioned on the rigid portion and the electrical contacts are positioned on the flexible portion. The flexible layer may be bent up to and beyond 90 degrees.

The rigid support, the semi-flexible support, and the semi-rigid support provide a low cost alternative to flexible interconnects of traditional inkjet system. Each of the rigid support, the semi-flexible support, and the semi-rigid support is configured to support a microfluidic die and electrical contacts on different physical planes and locations. By utilizing such alternatives to flexible interconnects, the cost of the disposable cartridge can be driven out of the design of fluid distribution systems.

BRIEF DESCRIPTION OF THE SEVERAL VIEWS OF THE DRAWINGS

In the drawings, identical reference numbers identify similar elements. The sizes and relative positions of elements in the drawings are not necessarily drawn to scale.

DETAILED DESCRIPTION

Figure 1A:
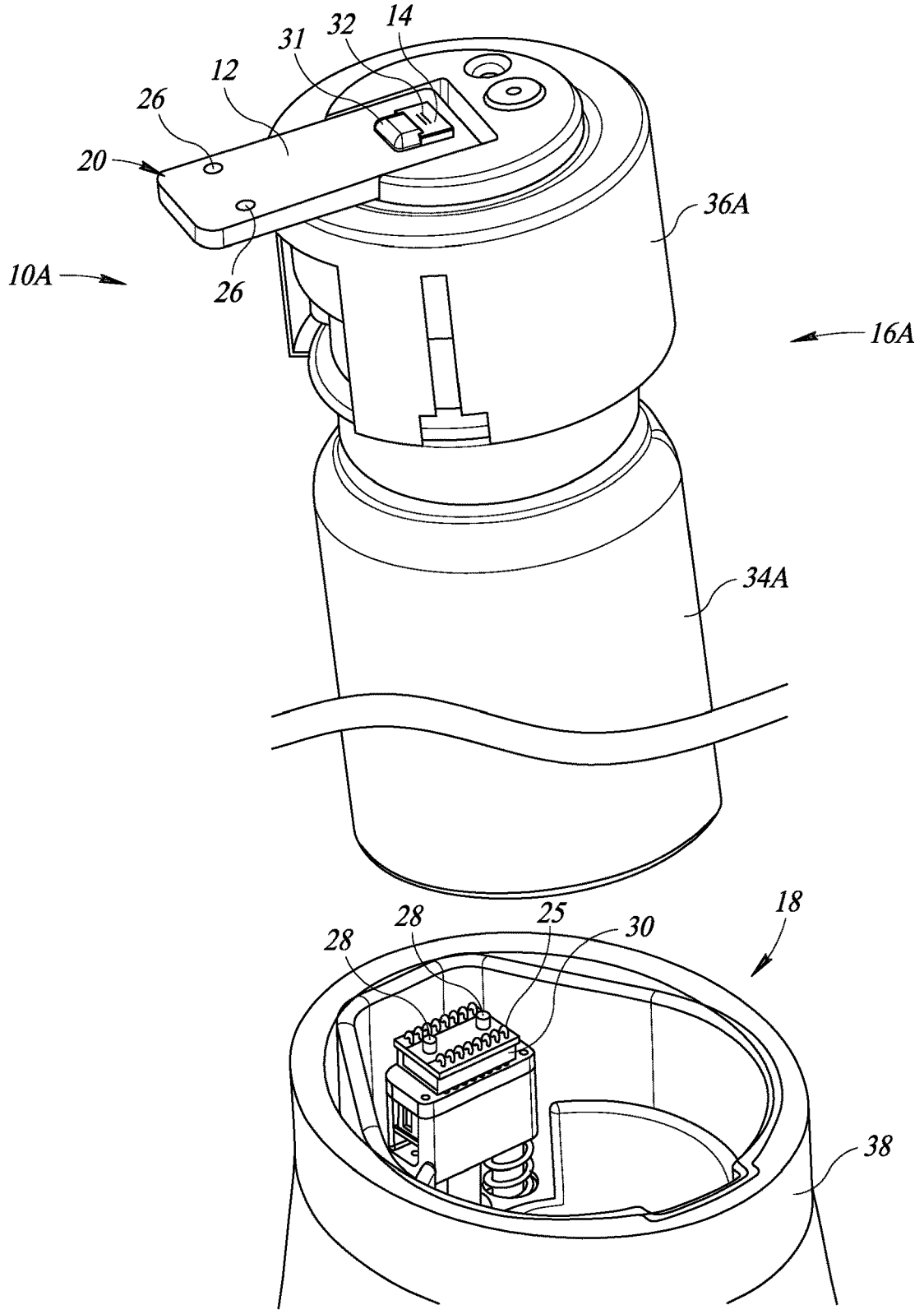
FIG. 1A is a first perspective view of a fluid distribution system that includes a rigid support according to one embodiment disclosed herein.

In the following description, certain specific details are set forth in order to provide a thorough understanding of various embodiments of the disclosure. However, one skilled in the art will understand that the disclosure may be practiced without these specific details. In some instances, well-known details associated with semiconductors, integrated circuits, and microfluidic delivery systems have not been described to avoid obscuring the descriptions of the embodiments of the present disclosure.

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

In the drawings, identical reference numbers identify similar features or elements. The size and relative positions of features in the drawings are not necessarily drawn to scale.

Figure 1B:
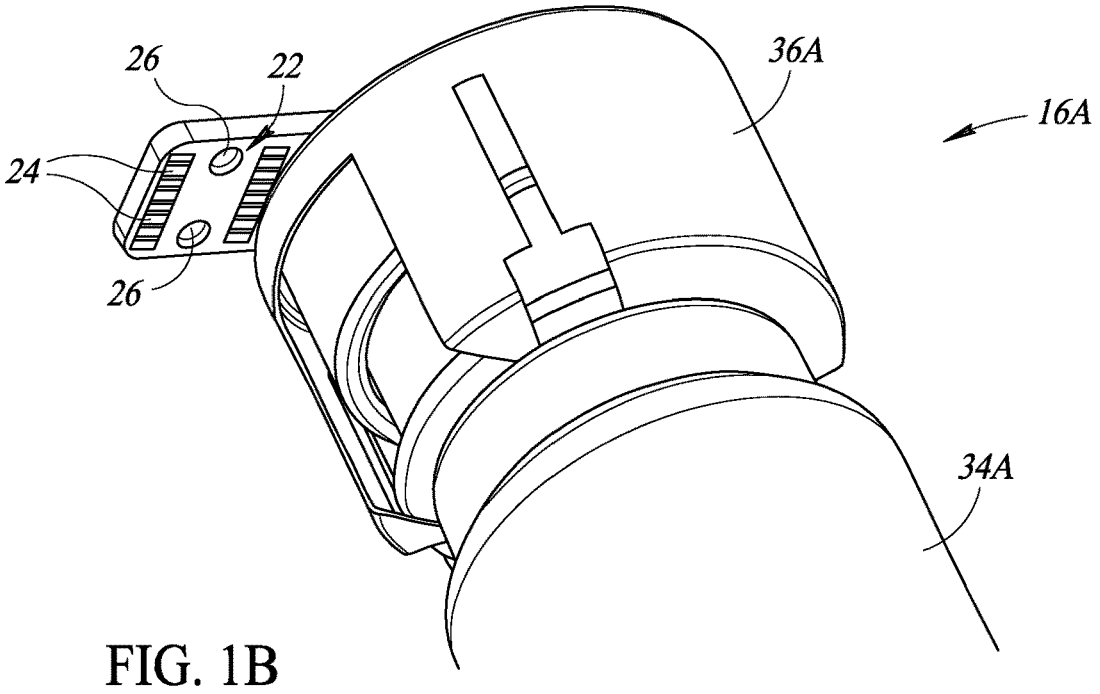
FIG. 1B is a second perspective view of the fluid distribution system and the rigid support of FIG. 1A according to one embodiment disclosed herein.

FIG. 1A is a first perspective view of a fluid distribution system 10A that includes a rigid support 12 according to one embodiment. The fluid distribution system 10A includes a microfluidic die 14, a cartridge 16A, and a receiving device 18. FIG. 1B is a second perspective view of the fluid distribution system 10A according to one embodiment disclosed herein. It is beneficial to review FIGS. 1A and 1B together.

The rigid support 12 provides a substantially inflexible substrate for the microfluidic die 14. The rigid support 12 includes a first surface 20 and an opposite second surface 22. The rigid support 12 also includes electrical contacts 24 and alignment holes 26. The body of the rigid support 12 may be made of any type material that provides a rigid substrate. For example, the rigid support 12 may be made of glass, silicon, or a printed circuit board (PCB), such as a FR4 PCB.

The electrical contacts 24 are electrically coupled to the microfluidic die 14. The electrical contacts 24 may be electrically coupled to the microfluidic die 14 through wires embedded in the support or any number of standard wire bond type connections. The electrical contracts 24 allow external devices, such as the receiving device 18, to be electrically coupled to the microfluidic die 14. The rigid support 12 may include any number of electrical contacts and may have any type of arrangement. In one embodiment, as shown in FIG. 1B, the rigid support 12 includes at least two rows of electrical contacts 24. In another embodiment, the rigid support 12 includes a single row of electrical contacts.

The alignment holes 26 are through holes that are configured to receive protruding elements, such as engaging elements 28, to align the electrical contacts 24 with an external electronic device, such as electrical connection receiver 30 of the receiving device 18, and ensure that there is a proper electrical connection between the electrical contacts 24 and electrical connections 25 of the external electronic device. The engaging elements 28 and the electrical connection receiver 30 will be discussed in further detail below. The alignment holes 26 extend through the first surface 20 and the second surface 22. The alignment holes 26 are optional and other alignment options may be included. The rigid support 12 may include any number of alignment holes 26 and each alignment hole 26 may have any shape. In one embodiment, as shown in FIG. 1B, the alignment holes 26 are positioned between a first row of electrical contacts 24 and a second row of electrical contacts 24, which align with the two rows of electrical connections 25 on the electrical connection receiver 30.

The microfluidic die 14 is configured to eject fluid to an environment external to the fluid distribution system 10A. The microfluidic die 14 includes nozzles 32 and chambers, an inlet path in fluid communication with the chambers, and heaters or other fluid moving elements that are configured to be driven by signals from the contacts 24 to eject fluid from the die. The microfluidic die 14 may dispense any type of fluid, such as ink, water, fragrance oil, nutrients, and pesticides. The microfluidic die 14 will be discussed in further detail with respect to FIG. 5D.

An encapsulant 31 covers conductive wires coupled to the microfluidic die 14, while leaving the nozzles 32 exposed. A close-up view of the microfluidic die 14 is shown, for example, in FIG. 5D. The wires couple contact pads on the microfluidic die 14 to contact pads on the first surface 20 of the rigid support 12. The contact pads on the first surface 20 of the rigid support 12 are electrically coupled to the electrical contacts 24 through electrical connections in the support.

Each of the nozzles 32 provides a fluid path to eject fluid from internal chambers of the microfluidic die 14 to an environment external to the fluid distribution system 10A. The number and arrangement of the nozzles 32 are shown for illustrative purposes. The microfluidic die 14 may include any number of nozzles 32, and the nozzles 32 may have any arrangement.

Although not shown, the microfluidic die 14 also includes a plurality of electrical traces on the die that are coupled to the conductive wires and provide signals to drive the ejection of fluid. The microfluidic die 14 may eject fluid using heaters or piezo-electric techniques. The drive signals are provided from another die, such as an application specific integrated circuit (ASIC) or a processor that send the drive signals through the electrical connections 25 in the receiving device 18 to the rigid support 12 to the die.

The cartridge 16A includes a reservoir 34A and a cap 36A. The reservoir 34A stores fluid to be dispensed by the microfluidic die 14. The reservoir 34A may store any type of fluid, such as ink, water, fragrance oil, nutrients, and pesticides. The cap 36A encloses the reservoir 34A. The reservoir 34A may be screwed in or snapped in to the cap 36A. The cap 36A helps move liquid from the reservoir 34A to the microfluidic die 14. The reservoir may be any numbers of shapes and sizes as dictated by the final product's intended environment.

The rigid support 12 is positioned on the cap 36A of the cartridge 16A. Particularly, the first surface 20 of the rigid support 12 faces away from the cartridge 16A and the second surface 22 faces the cartridge 16A. In one embodiment, the rigid support 12 partially overhangs from the cap 36A such that the electrical contacts 24 and the alignments holes 26 are cantilevered from the cap 36A. Accordingly, the electrical contacts 24 are left exposed to be connected to external devices, such as the receiving device 18.

Figure 3A:
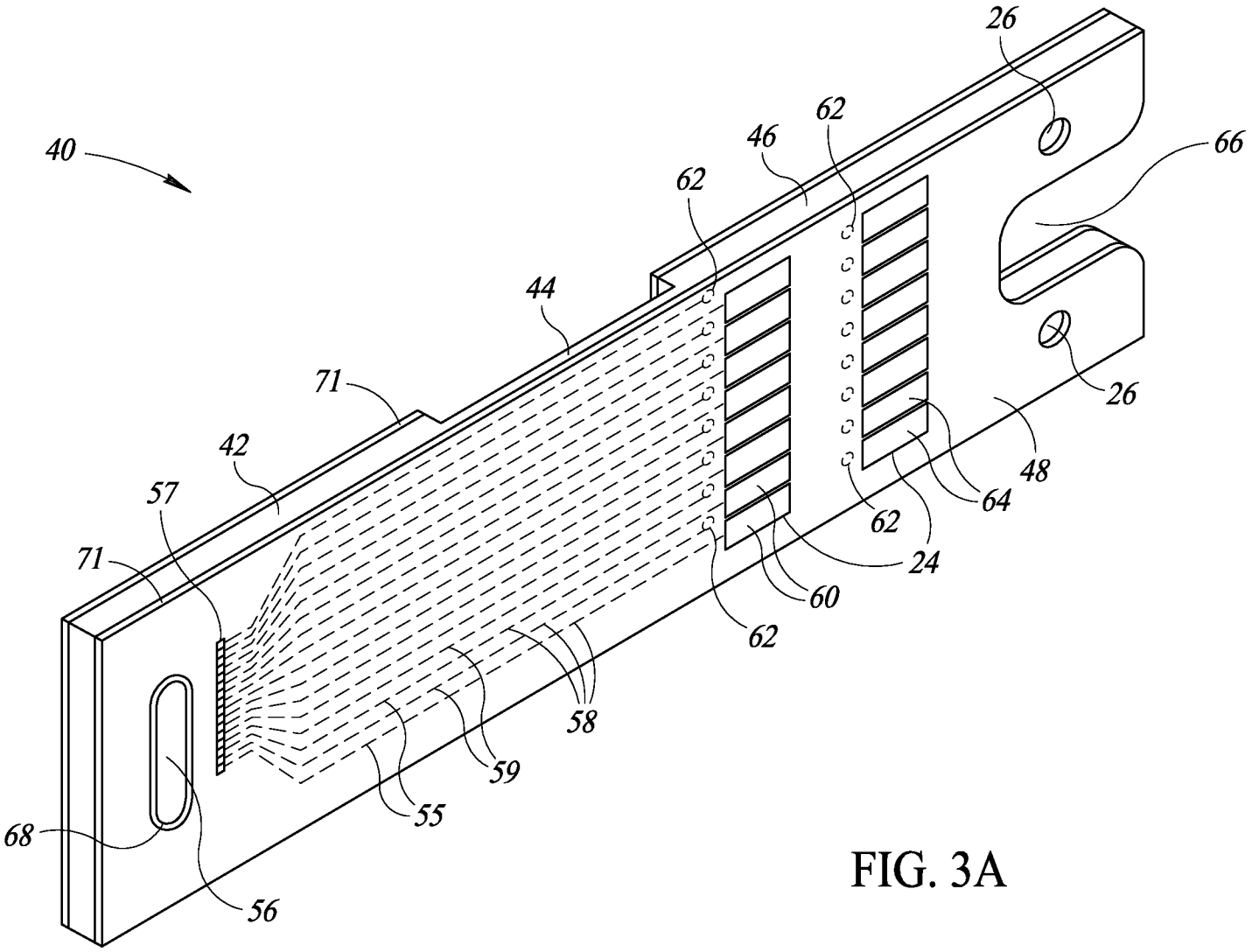
FIGS. 3A-3C are views of the semi-flexible support of FIG. 2.

Although not shown in FIGS. 1A and 1B, the rigid support 12 includes a fluid opening, such as fluid opening 56 of FIG. 3A. The fluid opening is a through hole that extends through the first surface 20 and the second surface 22. The fluid opening underlies the microfluidic die 14. The fluid opening provides a fluid path such that fluid may flow from the reservoir 34A, through the cap 36A and the rigid support 12, and to the microfluidic die 14.

The microfluidic die 14 is positioned on the first surface 20 on a first end of the rigid support 12 and the electrical contacts 24 are positioned on the second surface 22 on a second end, opposite to the first end, of the rigid support 12. Accordingly, the rigid support 12 allows the nozzles 32 of the microfluidic die 14 and the electrical contacts 24 to be at two different physical planes and locations, without the expense of a flexible interconnect.

The receiving device 18 includes a housing 38, the engaging and alignment elements 28, and the electrical connection receiver 30. The housing 38 is configured to receive the cartridge 16A. Namely, the cartridge 16A is inserted in to the housing 38. When the cartridge 16A is inserted, electrical connections 25 of the electrical connection receiver 30 contact the electrical contacts 24 of the rigid support 12, thus, electrically coupling the electrical connection receiver 30 to the microfluidic die 14. In addition, the engaging elements 28 engage the alignment holes 26 to properly align the electrical contacts 24 with the electrical connection receiver 30. In one embodiment, the electrical connection receiver 30 is configured to control or drive the microfluidic die to eject fluid from the reservoir 34A.

Figure 2:
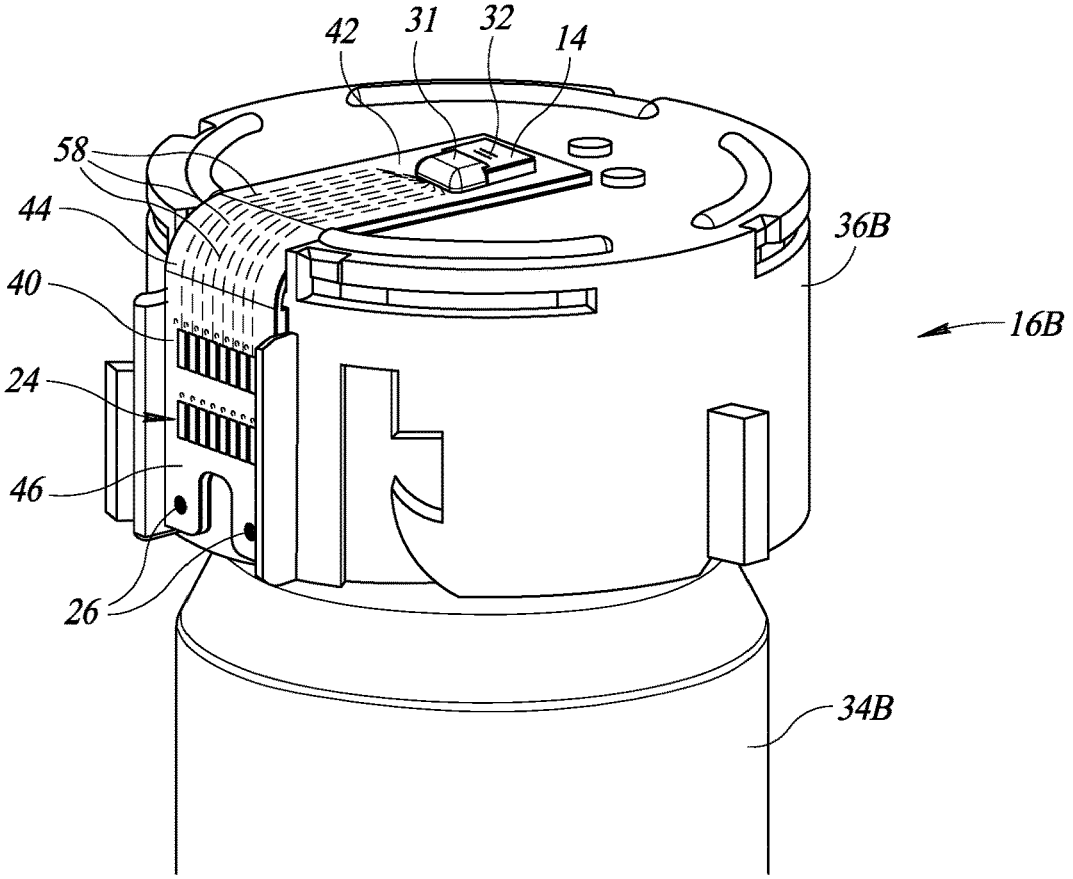
FIG. 2 is a perspective view of a cartridge of a fluid distribution system that includes a semi-flexible support according to one embodiment disclosed herein.

FIG. 2 is a perspective view of a cartridge 16B of a fluid distribution system that includes a flexible support 40 according to an embodiment of the present disclosure.

The microfluidic die 14 is positioned on a first rigid portion 42 of the flexible support 40. As previously discussed, the microfluidic die 14 includes the nozzles 32, chambers, and heating or piezo-electric elements that eject fluid. The encapsulant 31 covers conductive wires coupled to the microfluidic die 14, while leaving the nozzles 32 exposed. The nozzles 32 provide fluid paths to eject fluid from internal chambers of the microfluidic die 14. The microfluidic die 14 will be discussed in further detail with respect to FIG. 5D.

Similar to the cartridge 16A, the cartridge 16B includes a reservoir 34B and a cap 36B. The reservoir 34B stores fluid, such as ink, water, or fragrance oil, and the cap 36B encloses the reservoir 34B. Fluid stored in the reservoir 34B is delivered from the reservoir 34B, through the cap 36B and the flexible support 40, and to the microfluidic die 14. The cartridge 16B is inserted in to a receiving device, such as the receiving device 18. The supports described in this disclosure and variations of the described supports can be applied to other microfluidic systems that do not have a cap or cartridge as described with respect to FIGS. 1A to 2. For example, the supports may be incorporated in a microfluidic system where fluid travels some distance through a pipe or channel to the support to be ejected by the microfluidic die. This arrangement may be implemented in a greenhouse.

In contrast to the rigid support 12, a central portion of the flexible support 40 is bendable and adjustable to conform to a size and shape of an object to which it will be attached. In particular, the flexible support 40 includes a first rigid portion 42, a flexible portion 44, and a second rigid portion 46. The first rigid portion 42 is separated from the second rigid portion 46 by the flexible portion 44. The first rigid portion 42 is positioned on a top of the cap 36B, and the flexible portion 44 is curved over an edge of the cap 36B. The second rigid portion 46 is positioned on a sidewall of the cap 36B, which is substantially perpendicular to the top of the cap 36B. The flexible support 40 will be discussed in further detail with respect to FIGS. 3A to 3C.

The microfluidic die 14 is positioned on the first rigid portion 42 of the flexible support 40, overlying the top of the cap 36B. As will be discussed in further detail below, the microfluidic die 14 is positioned over a fluid opening 56 and is electrically coupled to the electrical contacts 24 through contact pads 57 and conductive wires 58. The electrical contacts 24 are positioned on the second rigid portion 46, which is on the sidewall of the cap 36B. Accordingly, the flexible support 40 allows the microfluidic die 14 and the electrical contacts 24 to be on two different physical planes at different locations. It should be noted that although the electrical contacts 24 are illustrated at approximately a 90 degree angle with respect to the top of the cap 36B, other angles are achievable depending on the design of the cap 36B.

In this embodiment, the electrical contacts 24 are along the side of the cap such that the contacts can be aligned with and positioned adjacent to electrical prongs or contacts in a receiving device. Electrical control signals may be transmitted to the microfluidic die through the contacts 24 from the receiving device, such as from a processor, a controller, or other ASIC.

Figure 3B:
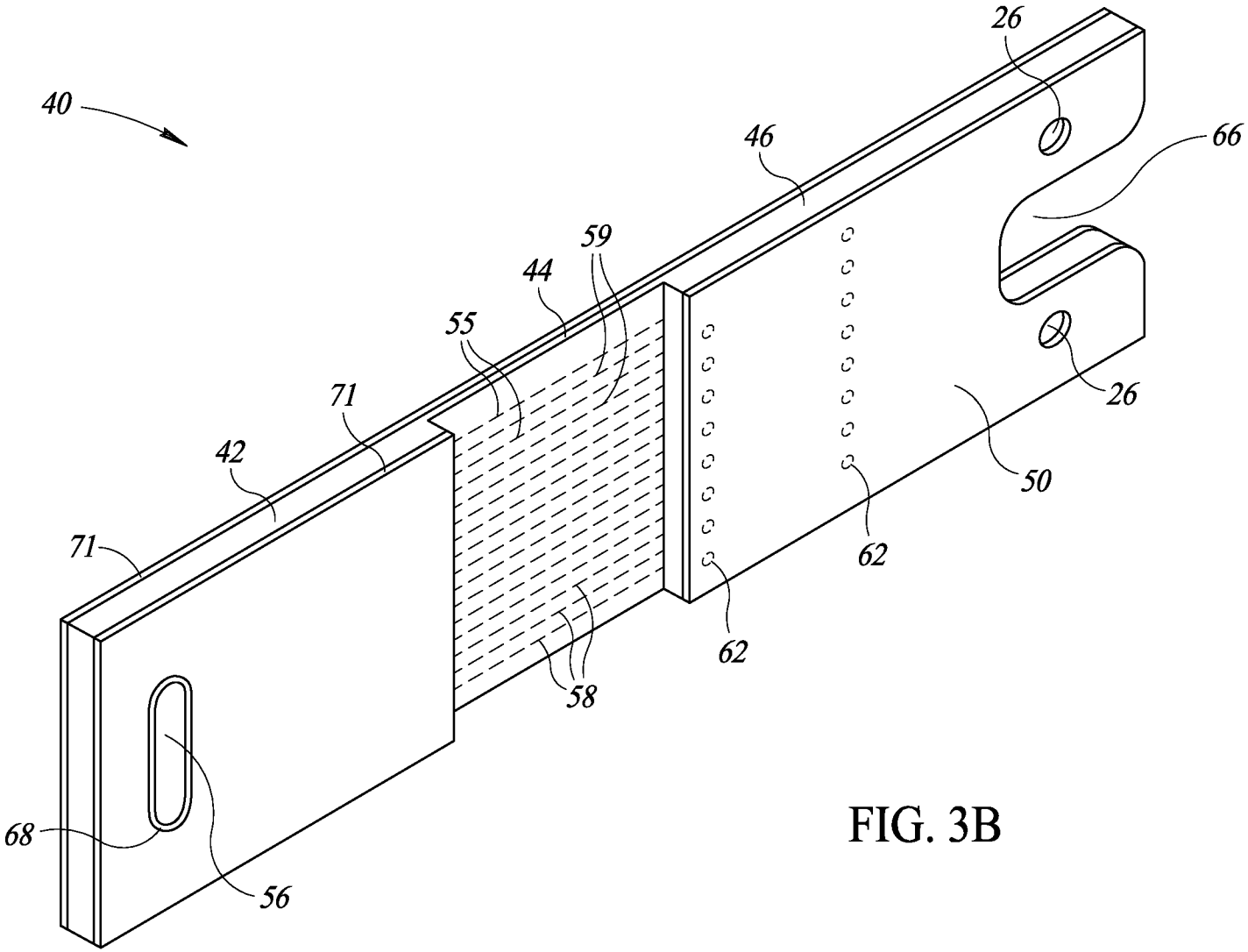
Figure 3C:
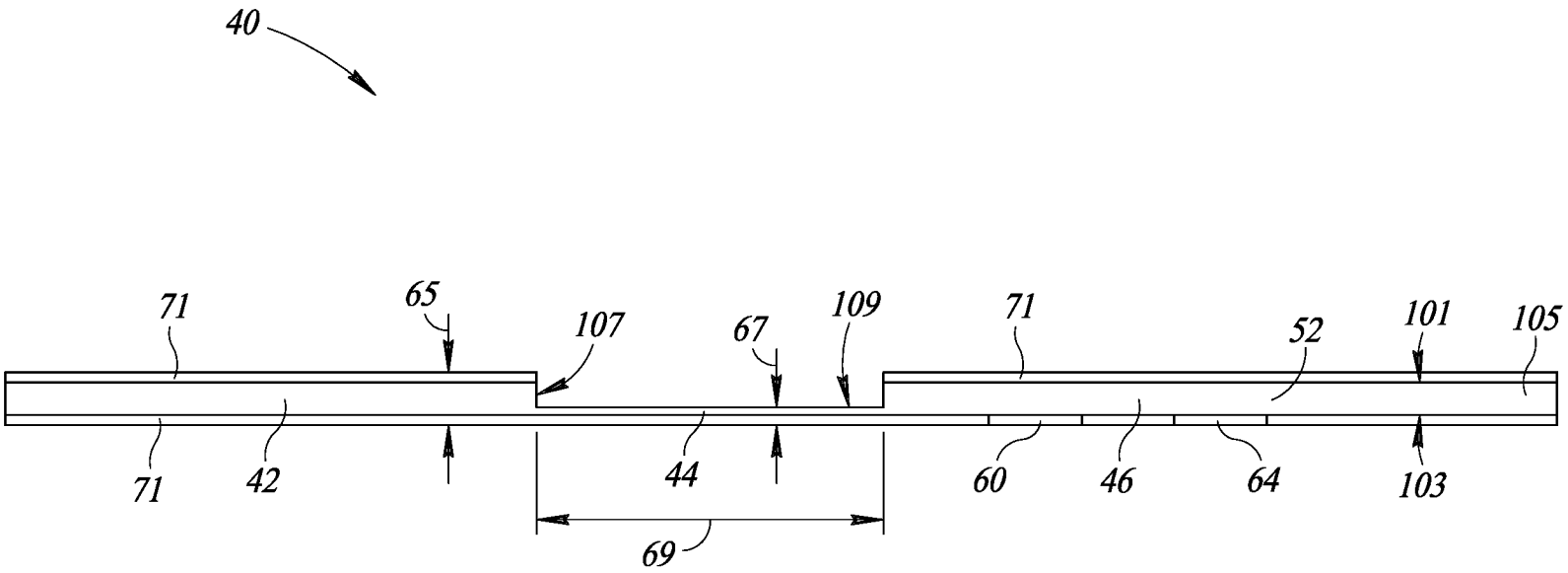

FIG. 3A is a perspective view of a first side 48 of the flexible support 40. FIG. 3B is a perspective view of a second side 50, opposite to the first side 48, of the flexible support 40. FIG. 3C is a side view of a third side 52 of the flexible support 40. It is beneficial to review FIGS. 3A to 3C together. The flexible support 40 includes the electrical contacts 24, contact pads 57, conductive wires 58, alignment holes 26, and a fluid opening 56.

As previously discussed, the electrical contacts 24 are electrically coupled to the microfluidic die 14 and provide contacts for external connections. The electrical contacts 24 are electrically coupled to the microfluidic die 14 through the contact pads 57 and the conductive wires 58. Namely, the electrical contacts 24 and the contact pads 57 are electrically coupled to each other by the conductive wires 58, and the microfluidic die 14 is positioned over the fluid opening 56 and electrically coupled to the contact pads 57. In one embodiment, the conductive wires 58 are electrical traces. The microfluidic die 14 may be electrically coupled to the contact pads 57 using a variety of techniques, such as wire bonding, tape automated bonding, ultrasonic single point bonding, and anisotropic conductive film. The number and arrangement of the electrical contacts 24 are shown for illustrative purposes and the flexible support 40 may include any number of electrical contacts and may have any type of arrangement.

In one embodiment, as shown in FIGS. 3A and 3B, a first plurality of conductive wires 55 of the conductive wires 58 is electrically coupled to a first plurality of electrical contacts 60 of the electrical contacts 24, and a second plurality of conductive wires 59 of the conductive wires 58 is electrically coupled to a second plurality of electrical contacts 64 of the electrical contacts 24 through conductive plugs 62. As shown in FIGS. 3A and 3B, the first plurality of conductive wires 55 and the second plurality of conductive wires 59 may be alternating in position. Namely, every other conductive wire of the conductive wires 58 may be one of the first plurality of conductive wires 55 and the remaining conductive wires of the conductive wires 58 may be one of the second plurality of conductive wires 59. In the same or another embodiment, the first plurality of electrical contacts 60 are aligned in a first row and the second plurality of electrical contacts 64 are aligned in a second row that is parallel to the first row.

In one embodiment, the conductive wires 58 are embedded within the flexible support 40 to prevent damage to the conductive wires 58 and a possible short circuit. In addition, embedding the conductive wires 58 within the flexible support 40 allows a portion of the flexible support 40 to be removed. As will be discussed in further detail below, a center portion of the flexible support 40 is removed to fabricate the flexible portion 40. In an alternative embodiment, the conductive wires 58 are formed on a surface of the flexible support 40, such as the surface on the first side 48 of the flexible support 40. In this embodiment, a solder-mask may be used to cover the conductive wires 58, while leaving the electrical contacts 24 exposed.

As previously discussed, the alignment holes 26 are through holes that are configured to receive protruding elements to align the electrical contacts 24 with an external device. For example, in one embodiment, the alignment holes 26 are configured to receive engaging elements on a sidewall of the cap 36B to align the electrical contacts 24 with contacts of a receiving device configured to receive the cartridge 16B. The flexible support 40 may include any number of alignment holes 26 and each alignment hole 26 may have any shape. In one embodiment, the flexible support 40 is fabricated without the alignment holes 26.

In the same or another embodiment, the flexible support 40 further includes a notch 66. Similar to the alignment holes 26, the notch 66 is configured to align the flexible support 40 with an external component. For example, in one embodiment, the notch 66 is mated with a compatible element of an external device. This provides precision alignment to align the electrical contacts 24 with external electrical connections to provide signals to the microfluidic die 14. This alignment allows for easy, quick, and accurate replacement or insertion of a portion of the device that includes the microfluidic die 14. For example, if the microfluidic die 14 is ejecting a fluid that is known to dry and clump over time, i.e. a lifecycle of the microfluidic die 14 is in the range of a few weeks to a couple months, the entire cartridge holding the microfluidic die 14 and the flexible support 40 can be easily removed from the more permanent receiving device and replaced with a new cartridge as the contacts of the support are configured to be easily put in contact with electrical connections in the receiving device. In other words, this support allows for a system where a cartridge with a microfluidic die is replaceable and disposable while a portion of the housing that includes a microprocessor remains for repeated use, longer than the lifecycle of one microfluidic die.

In the same or another embodiment, the flexible support 40 further includes protective layers 71. The protective layers 71 are configured to protect the flexible support 40 from any external damage. The protective layers 71 may be formed on the first side 48, the second side 50, or both the first side 48 and the second side 50 of the flexible support 40. In another embodiment, the flexible support 40 is formed without the protective layers 71. The protective layers 71 may be made of silicon dioxide or any other suitable dielectric. In one embodiment, the protective layers 71 are solder-masks.

As best shown in FIG. 3C, the protective layers 71 are formed on a first surface 101 and a second surface 103 of a support material 105. The support material 105 is printed circuit board material or other dielectric material that houses and electrically isolates the electrical connections 58. The electrical connections 58 are formed in the support material 105 closer to the second surface 103 so that when the flexible portion 44 is formed, the electrical connections 58 remain embedded in the support material 105. There is more of the protective layer 71 on the second surface 103 than on the first surface 101, as a portion of the protective layer on the first surface is removed to form the flexible portion 44. The electrical contacts 24, in rows 60 and 64 are flush or otherwise coplanar with the protective layer 71 on the second surface 103. The first and second rigid portions 42 and 46 and the flexible portion 44 of the flexible support 40 are all formed of the same materials, with the flexible portion being flexible as a result of having less material.

The flexible portion 44 of the flexible support 40 may be fabricated by milling or thinning a specific portion of the flexible support 40. Namely, as best shown in FIG. 3C, a portion of the flexible support 40 is removed such that the first rigid portion 42 and the second rigid portion 46 each has a thickness 65 and the flexible portion 44 has a thickness 67 that is smaller than the thickness 65. By thinning the flexible portion 44, the flexible support 40 may be bent up to and beyond 90 degrees. This allows the microfluidic die 14 and the electrical contacts 24 to be on two different planes and locations, without the expense of a flexible interconnect. The central flexible portion 44 has a width 69 that may be adjusted based on a size and shape of the cap or other object on to which the flexible support will be placed. In addition, sidewalls 107 formed when the portions of the protective layer 71 and the support material 105 are removed. As shown in FIG. 3C, the sidewalls 107 may be substantially perpendicular or transverse to the second surface 103. In another embodiment, the sidewalls 107 are angled such that the sidewalls 107 slope from the first surface 101 toward a third surface 109 that is at the flexible portion 44.

The fluid opening 56 provides a fluid path through the flexible support 40. The fluid opening 56 extends through the first rigid portion 42 and underlies the microfluidic die 14. Accordingly, fluid may flow from the reservoir 34B, through the cap 36B and the flexible support 40, and to the microfluidic die 14.

In the same or another embodiment, the flexible support 40 further includes a liner 68. The liner 68 is configured to protect the flexible support 40 from any damage that may be caused by fluid flowing through the fluid opening 56.

The flexible support 40 may be made of any type of material that provides a rigid substrate. For example, the flexible support 40 may be made of glass, silicon, or a printed circuit board (PCB), such as a FR4 PCB.

Figure 4A:
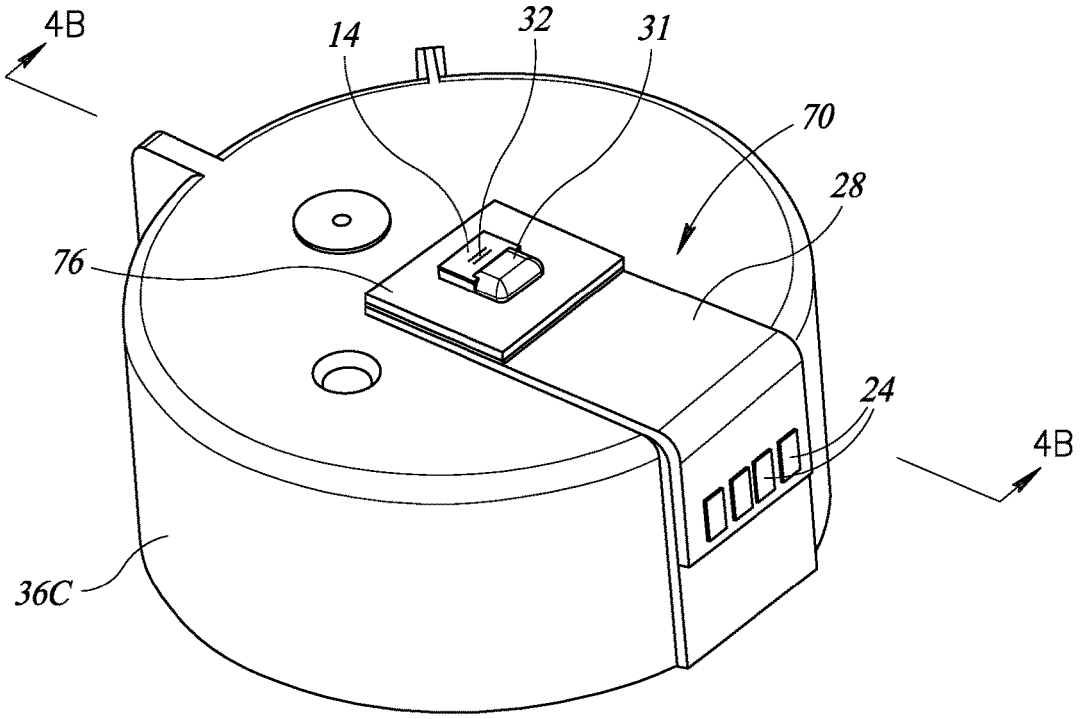
FIG. 4A is a perspective view of a semi-rigid support on a cap of a fluid distribution system according to one embodiment disclosed herein.
Figure 4B:
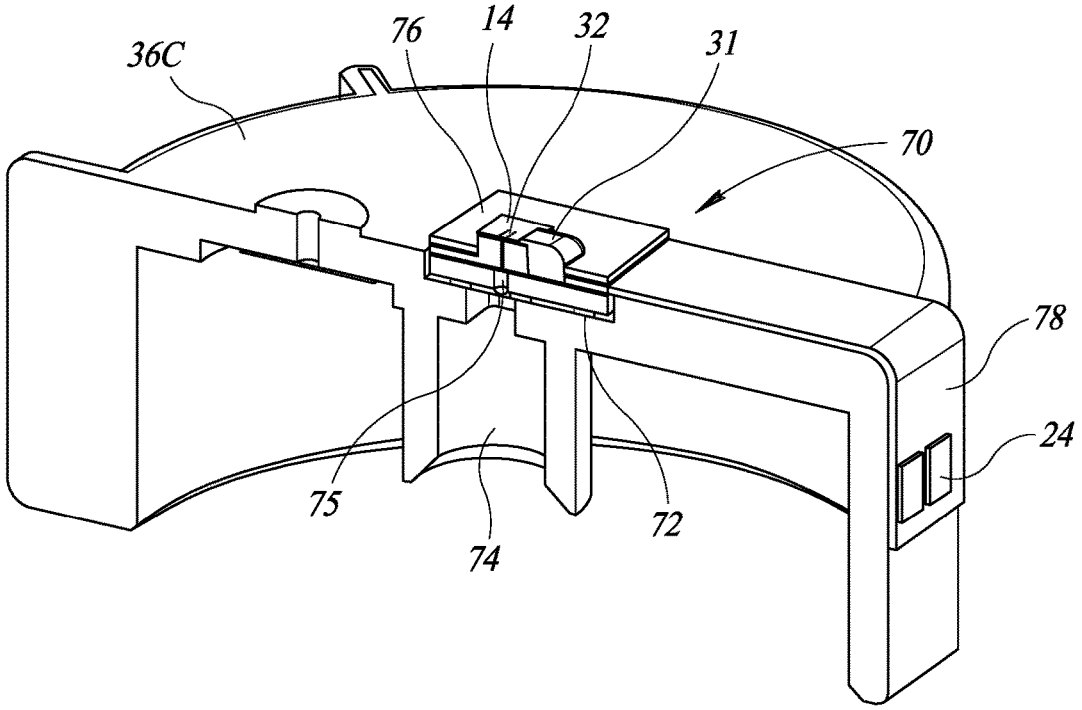
FIG. 4B is a cross-sectional view of the semi-rigid support and the cap of FIG. 4A.

FIG. 4A is a perspective view of an alternative embodiment of a flexible support 70 on a cap 36C of a fluid distribution system according to one embodiment disclosed herein. FIG. 4B is a cross-sectional view of the semi-rigid support 70, the cap 36C, and the microfluidic die 14 of FIG. 4A through cross-section line 4B-4B. It is beneficial to review FIGS. 4A and 4B together.

The microfluidic die 14 is positioned on the support 70. As previously discussed, the microfluidic die 14 includes the nozzles 32 through which fluid is ejected. The encapsulant 31 covers conductive wires coupled to the microfluidic die 14, while leaving the nozzles 32 exposed. The nozzles 32 provide fluid paths to eject fluid from internal chambers of the microfluidic die 14. The microfluidic die 14 will be discussed in further detail with respect to FIG. 5D.

Similar to the cap 36A and the cap 36B, the cap 36C is attachable to a reservoir, such as reservoirs 34A and 34B. Fluid stored in the reservoir is delivered from the reservoir, through the cap 36C and the semi-rigid support 70, and to the microfluidic die 14.

The cap 36C is configured to receive the semi-rigid support 70. In particular, the cap 36C includes an indentation 72 in a top surface of the cap 36C that is sized to receive a rigid portion 76 of the support 70. The cap 36C also includes an inlet path 74 that is aligned with a fluid opening 75 of the support 70. The inlet path 74 and the fluid opening 75 allow fluid to be provided to an inlet path of the microfluidic die 14.

The semi-rigid support 70 includes the rigid portion 76 and a flexible portion 78. The rigid portion 76 is positioned on the cap 36C and in the indentation 72. The flexible portion 78 extends from the rigid portion 76, over an edge of the cap 34C, and on to a sidewall of the cap 36C. As will be discussed in further detail with respect to FIGS. 5A to 5D, the support 70 and the rigid portion 76 are composed of a plurality of layers.

The microfluidic die 14 is positioned on the rigid portion 76, over the fluid opening 75, and on the top of the cap 36C. The electrical contacts 24 are positioned on the flexible portion 78 and on the sidewall of the cap 36C. Accordingly, the support 70 allows the microfluidic die 14 and the electrical contacts 24 to be at two different physical planes and locations. It should be noted that although the electrical contacts 24 are illustrated at approximately a 90 degree angle with respect to the top of the cap 36C, other angles are achievable depending on the design of the cap 36C. In an alternative embodiment, the microfluidic die 14 is positioned on the flexible portion 78 and on the sidewall of the cap 36C, and the electrical contacts 24 is positioned on the rigid portion 76 and on the top of the cap 36C.

Figure 5A:
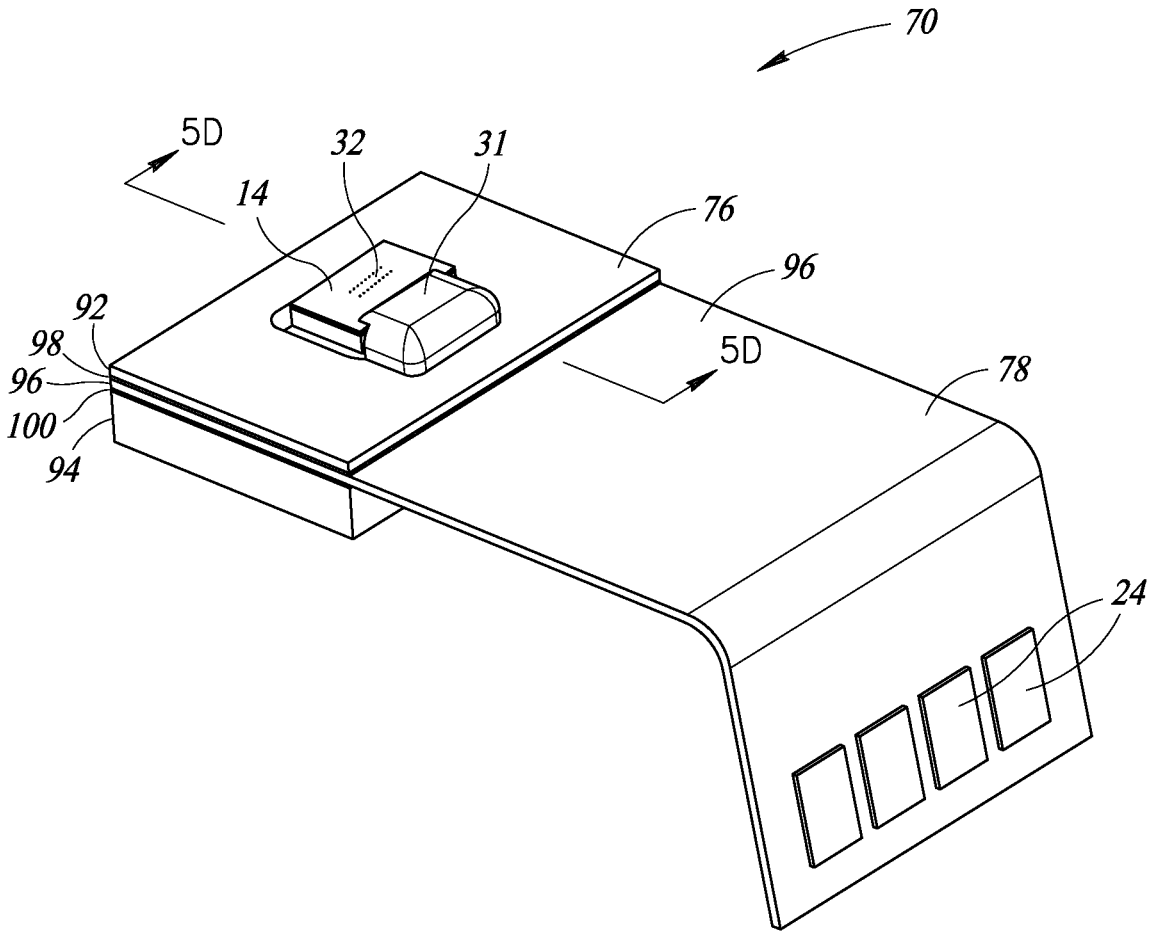
FIG. 5A is a perspective view of a microfluidic die on the semi-rigid support of FIG. 4A.
Figure 5B:
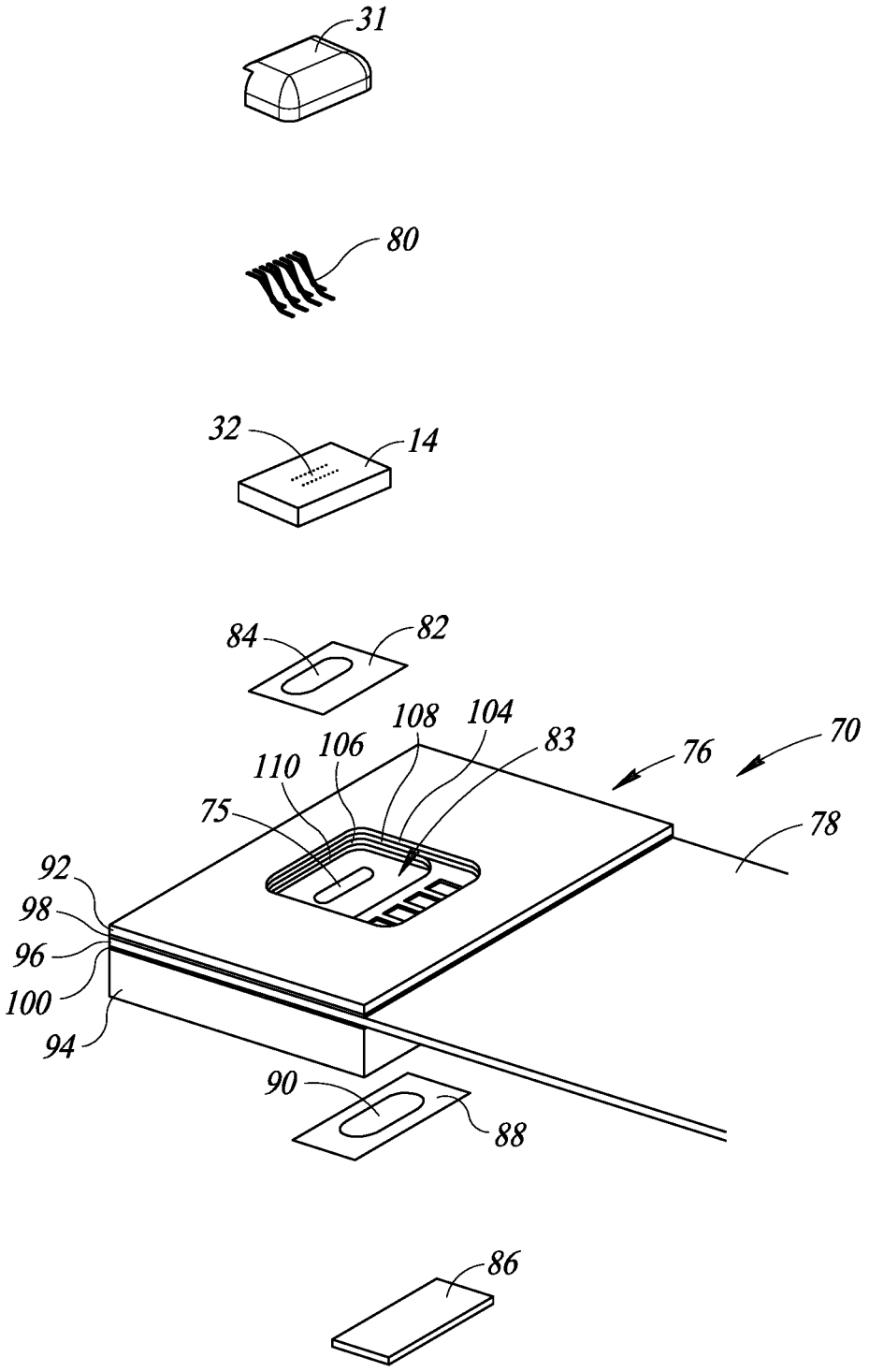
FIG. 5B is an exploded view of layers associated with the microfluidic die as attached to the semi-rigid support of FIG. 5A.
Figure 5C:
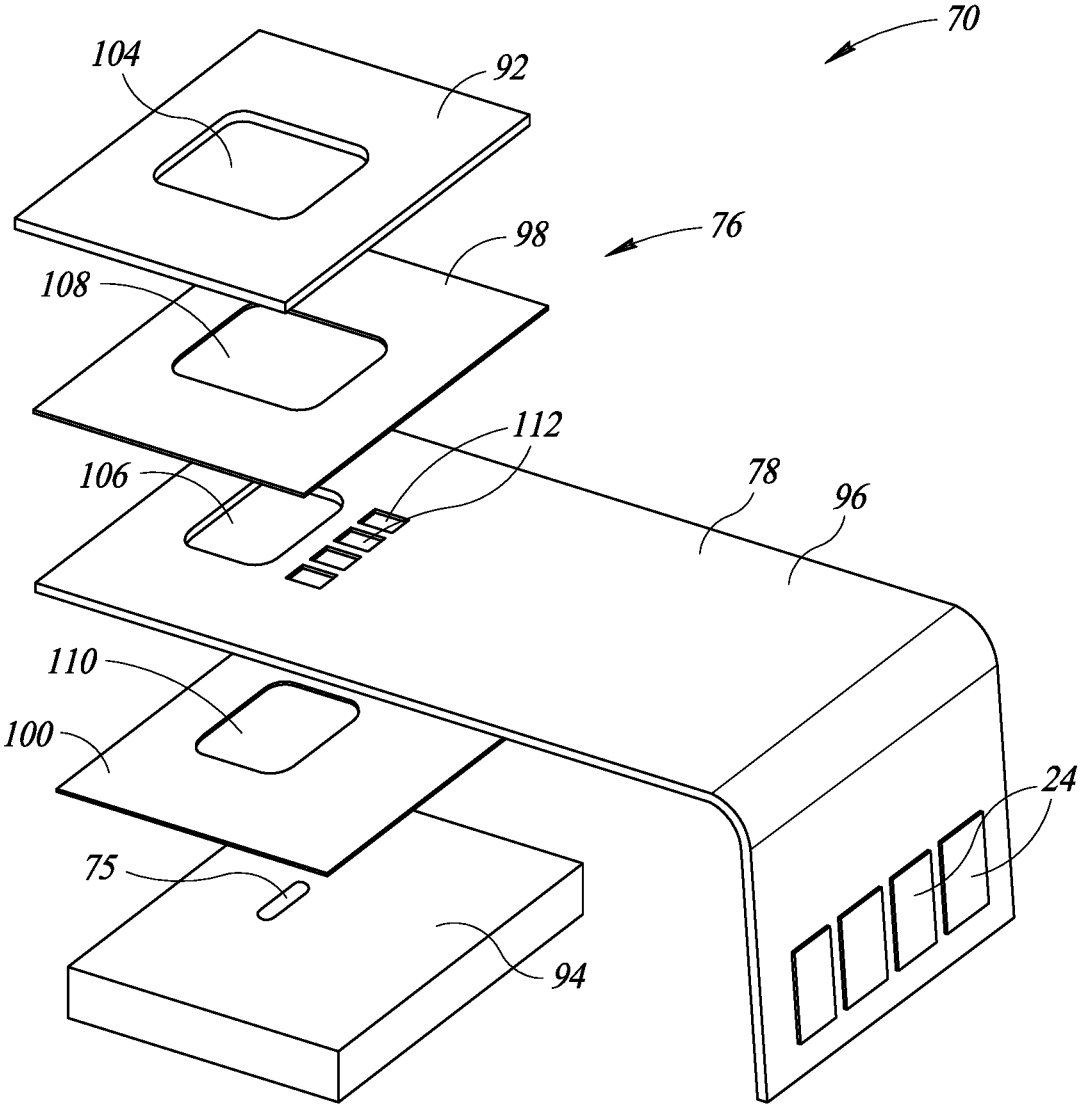
FIG. 5C is an exploded view of layers of a rigid portion of the semi-rigid support of FIG. 5B.
Figure 5D:
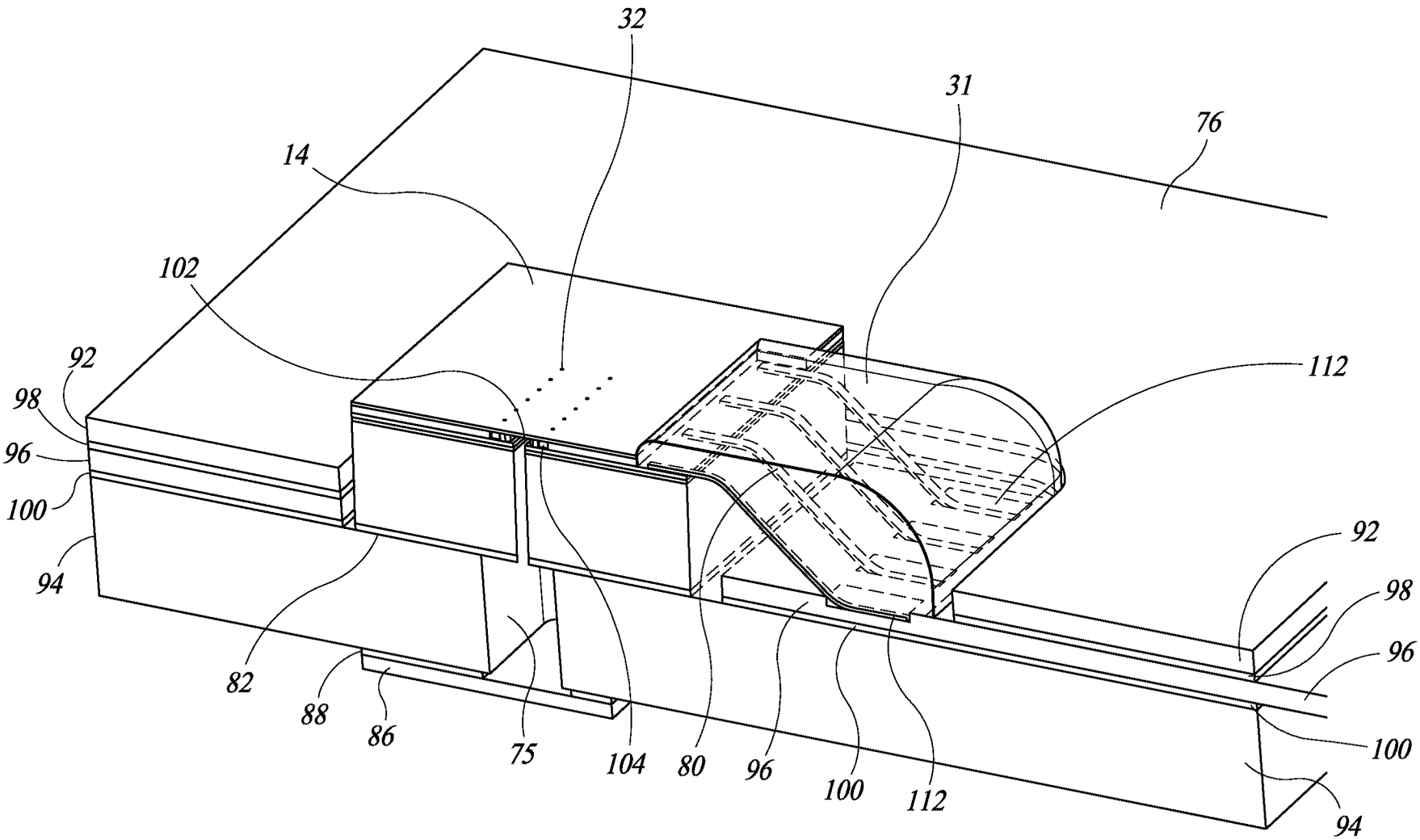
FIG. 5D is an enhanced, cross-sectional view of the microfluidic die and the semi-flexible support of FIG. 5A.

FIG. 5A is a perspective view of the microfluidic die 14 on the support 70. FIG. 5B is an exploded view of layers associated with the microfluidic die 14 as attached to the support 70. FIG. 5C is an exploded view of layers of the rigid portion of the support 70. FIG. 5D is a close-up, cross-sectional view of the microfluidic die 14 on the semi-rigid support 70. It is beneficial to review FIGS. 5A, 5B, 5C, and 5D together.

As best shown in FIGS. 5A and 5B, the microfluidic die 14 is attached to the rigid portion 76 of the support 70 by a first attachment layer 82. The first attachment 82 includes an opening 84 that is aligned with the fluid opening 75 of the support 70. The opening 84 and the fluid opening 75 are configured to provide a fluid path for fluid being provided to the microfluidic die 14 from a reservoir or from a pipe or other fluid transport device. The first attachment 82 may be any type of adhesive that is configured to couple the microfluidic die 14 to the rigid portion 76. For example, the first attachment 82 may be adhesive tape or glue. The attachment layer 82 is placed on a surface 83 of a second rigid layer 94 that is exposed through openings 104, 106, 108, and 110 in the rigid portion 76. The openings 104, 106, 108, and 110 is formed through a group of layers in the rigid portion 76 that include a first rigid layer 92, a flexible layer 96, a third attachment layer 98, and a fourth attachment layer 100. The first rigid layer 92, the second rigid layer 94, the flexible layer 96, the third attachment layer 98, and the fourth attachment layer 100 will be discussed in further detail below.

In the same or another embodiment, a filter 86 is coupled to the rigid portion 76 of the semi-rigid support 70. The filter 86 is configured to filter large particulates from fluid being provided to the microfluidic die 14, to prevent any blockage within the microfluidic die 14. In one embodiment, as shown in FIG. 5B, the filter 86 is positioned on a side of the rigid portion 76 that is opposite to a side of the microfluidic die 14. Similar to the microfluidic die 14, the filter 86 is attached to the rigid portion 76 of the semi-rigid support 70 by a second attachment layer 88. The second attachment layer 88 includes an opening 90 that is aligned with the opening 84 and the fluid opening 75. The opening 84, the fluid opening 75, and the opening 90 are configured to provide a fluid path for fluid being provided to the microfluidic die 14. The second attachment layer 88 may be any type of adhesive that is configured to couple the microfluidic die 14 to the rigid portion 76. For example, the second attachment 88 may be adhesive tape or glue. It should be noted that the filter 86 may be positioned anywhere in the fluid path of fluid being provided to the microfluidic die 14. For example, in another embodiment, the filter 86 is positioned directly under the microfluidic die 14, between the microfluidic die 14 and the rigid portion 76.

As best shown in FIG. 5C, the support 70 is composed of a plurality of layers. In particular, the support includes the first rigid layer 92, the second rigid layer 94, and the flexible layer 96. The first rigid layer 92 is coupled to a first side of the flexible layer 96 by the third attachment layer 98. The second rigid layer 94 is coupled to a second side, opposite to the first side, of the flexible layer 96 by the fourth attachment layer 100. The third attachment layer 98 and the fourth attachment layer 100 may be any type of adhesive that is configured to couple the first rigid layer 92 and the second rigid layer 94 to the flexible layer 96. For example, the first attachment 82 may be adhesive tape or glue.

The first rigid layer 92 and the second rigid layer 94 may each be made of any type material that provides a rigid substrate. For example, the first rigid layer 92 and the second rigid layer 94 may be made of glass, silicon, or a printed circuit board (PCB), such as a FR4 PCB.

The flexible layer 96 may be bent up to and beyond 90 degrees. This allows the microfluidic die 14 and the electrical contacts 24 to be on two different planes, without the expense of a flexible interconnect. The flexible layer 96 may be made of any type of flexible material. In one embodiment, the flexible layer is made of polyimide.

The first rigid layer 92 includes an opening 104, the flexible layer 96 includes an opening 106, the third attachment layer 98 includes an opening 108, and the fourth attachment layer 100 includes an opening 110. The openings 104, 106, 108, and 110 are designed to accommodate the microfluidic die 14. As best shown in FIGS. 5A and 5B, the microfluidic die is positioned in the openings 104, 106, 108, and 110 and over the fluid opening 75.

The second rigid layer 94 includes the fluid opening 75. The size of the fluid opening 75 is designed to limit the amount of fluid being provided to the microfluidic die 14. For example, as shown in FIG. 5C, the size of the opening 104 may be relatively small compared to the microfluidic die 14 to provide a relatively small amount of fluid to the microfluidic die 14. In one embodiment, the fluid opening 75 is smaller than each of the openings 14, 106, 108, and 110.

As best shown in FIGS. 5B to 5D, the flexible layer 96 includes a plurality of exposed contacts 112. One or more of the exposed contacts 112 are electrically coupled to the electrical contacts 24. The exposed contacts 112 may be electrically coupled to the electrical contacts 24 through conductive wires or traces embedded in the flexible layer 96. As best shown in FIG. 5D, the microfluidic die 14 is coupled to the exposed contacts 112 by conductive wires 80. The microfluidic die 14 may be coupled to the exposed contacts 112 using a variety of techniques, such as wire bonding, tape automated bonding, ultrasonic single point bonding, and anisotropic conductive film. The encapsulant 31 covers the wires to prevent shorting and other electrical issues.

As best shown in FIG. 5D, the microfluidic die 14 includes an inlet path 102 and internal chambers 104. The inlet path 102 is in fluid communication with the fluid opening 75 and an internal channel, which is in fluid communication with the internal chambers 104. The fluid opening 75, the inlet path 102, and the internal channel form a fluid path. Each of the nozzles 32 is positioned above a respective one of the internal chambers 104. The microfluidic die 14 may have any number of chambers and nozzles, including one chamber and nozzle.

When in use, fluid flows through the fluid opening 75, the inlet path 102, the internal channel, and in to the internal chambers 104. The fluid in the internal chambers 104 is then ejected from the nozzles 32. For example, in one embodiment, the microfluidic die 14 includes a heater that heats the fluid in the internal chambers 104 and vaporizes the fluid to create bubbles. The expansion that creates the bubble causes fluid to eject from the nozzles 32. In an alternative embodiment, a piezo-electric element is used to mechanically move and eject a drop of the fluid.

In accordance with one or more embodiments, the rigid support 12, the flexible support 40, and the semi-rigid support 70 each provide a low cost solution to replace flexible interconnects of traditional thermal inkjet systems. Each of the rigid support 12, the flexible support 40, and the semi-rigid support 70 is configured to support the microfluidic die 14 on a different physical plane than the electrical contacts 24. By utilizing such alternatives to flexible interconnects, the cost of the disposable cartridge can be driven out of the design of fluid distribution systems.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A microfluidic component, comprising:
- a unitary support having a continuous material throughout, a first surface and an opposite second surface, the continuous material including:
  - a first end;
  - a second end opposite the first end;
  - a first portion positioned adjacent to the first end;
  - a second portion positioned adjacent to the second end; and
  - a third portion coupled between the first portion and the second portion, the first portion and the second portion having a first and second thickness, respectively, the third portion having a third thickness that is less than the first thickness and less than the second thickness.

2. The microfluidic component of claim 1, wherein the first portion is a first rigid portion, the second portion is a second rigid portion, and the third portion is a flexible portion that separates the first and second rigid portions from each other.

3. The microfluidic component of claim 1, further comprising:
- an opening extending through the first portion from the first surface to the opposite second surface; and
- a first die on the first surface of the unitary support on the first portion and aligned with the opening.

4. The microfluidic component of claim 3, further comprising contact pads on the first surface, the first die being a microfluidic die and is electrically coupled to the contact pads.

5. The microfluidic component of claim 1, wherein the first thickness and the second thickness are substantially equal.

6. The microfluidic component of claim 1, further comprising an opening extending through the first portion from the first surface to the opposite second surface and a liner that covers a sidewall of the opening.

7. The microfluidic component of claim 1, further comprising contact pads on the first surface, the contact pads include a first group of the contact pads on the first portion and a second group of contact pads on the second portion.

8. The microfluidic component of claim 7, further comprising electrical traces coupling the first group of the contact pads to the second group of the contact pads and extending from the first portion to the second portion on the third portion of the unitary support.

9. The microfluidic component of claim 1, further comprising a first protective layer on the first surface and a second protective layer on the opposite second surface.

10. A microfluidic component, comprising:
- a unitary support having a continuous integral layer throughout, the continuous layer including:
  - a first surface;
  - a second surface, a third surface, and a fourth surface opposite the first surface;
  - a first end and a second end, the continuous layer extending from the first end to the second end;
  - a first portion positioned at the first end, the first portion having a first thickness that extends from the first surface to the second surface;
  - a second portion positioned at the second end, the second portion having a second thickness that extends from the first surface to the third surface; and
  - a third portion having a third thickness that extends from the first surface to the fourth surface, the third thickness being less than the first thickness and less than the second thickness, the third portion coupling the second portion to the first portion.

11. The microfluidic component of claim 10, further comprising:
- a first protective layer on the first surface;
- a second protective layer on the second surface;
- a third protective layer on the third surface; and
- an opening that extends through the first thickness of the first portion, the first protective layer, and the second protective layer.

12. The microfluidic component of claim 11, further comprising a plurality of contact pads on the first surface on the first portion and adjacent to the opening.

13. The microfluidic component of claim 11, further comprising a microfluidic die coupled to the first protective layer on the first surface on the first portion and aligned with the opening.

14. The microfluidic component of claim 10, further comprising a plurality of contact pads on the first surface on the second portion, the plurality of contact pads including a first row of contact pads and a second row of contact pads.

15. The microfluidic component of claim 10, further comprising conductive wires embedded in the unitary support that extend from the first portion to the second portion through the third portion.

16. A microfluidic component, comprising:
- a continuous support having a first end opposite a second end and a first side opposite a second side, the first side having a first surface, the continuous support including:
  - an integral layer of a continuous material that extends from the first end to the second end of the continuous support, the integral layer having:
    - a first portion having a first thickness that extends from the first surface to a second surface on the second side of the continuous support;
    - a second portion having a second thickness that extends from the first surface to a third surface on the second side of the continuous support; and
    - a third portion having a third thickness that extends from the first surface to a fourth surface on the second side of the continuous support, the second thickness being less than the first thickness and less than the third thickness, the second portion coupling the first portion to the third portion.

17. The microfluidic component of claim 16, further comprising an opening extending through the first thickness of the first portion of the continuous support.

18. The microfluidic component of claim 16, further comprising a first die positioned on the first surface of the continuous support.

19. The microfluidic component of claim 18, wherein the first die is electrically coupled to a plurality of contact pads on the microfluidic support by a plurality of conductive wires, and an encapsulant covering the plurality of conductive wires.

20. The microfluidic component of claim 16, wherein the third portion is a flexible portion.

* * * * *